US007138917B2

(12) United States Patent
Nishiwaki

(10) Patent No.: US 7,138,917 B2
(45) Date of Patent: Nov. 21, 2006

(54) ON-VEHICLE TERMINAL APPARATUS FOR DEDICATED SHORT RANGE COMMUNICATION SYSTEM

(75) Inventor: Takeshi Nishiwaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 61 days.

(21) Appl. No.: 10/943,931

(22) Filed: Sep. 20, 2004

(65) Prior Publication Data

US 2005/0237223 A1 Oct. 27, 2005

(30) Foreign Application Priority Data

Apr. 22, 2004 (JP) ..... 2004-126758

(51) Int. Cl.
*G08B 13/14* (2006.01)

(52) U.S. Cl. ..... 340/572.1; 340/572.7; 340/505

(58) Field of Classification Search ..... 340/905, 340/928, 935, 988, 539.21, 539.22, 539.23, 340/539.24, 505, 10.2, 572.1, 572.8, 572.9, 340/5.21, 5.64, 10.5; 701/101, 102, 115
See application file for complete search history.

(56) References Cited

U.S. PATENT DOCUMENTS 5,025,253 A * 6/1991 DiLullo et al. ..... 340/10.41
5,530,702 A * 6/1996 Palmer et al. ..... 370/445
5,995,898 A * 11/1999 Tuttle ..... 701/102
6,112,152 A * 8/2000 Tuttle ..... 701/115
6,222,463 B1 * 4/2001 Ral ..... 340/928
6,459,965 B1 * 10/2002 Polivka et al. ..... 701/19
6,525,648 B1 * 2/2003 Kubler et al. ..... 340/10.33
6,600,418 B1 * 7/2003 Francis et al. ..... 340/572.1
6,894,601 B1 * 5/2005 Grunden et al. ..... 340/10.41

FOREIGN PATENT DOCUMENTS

JP 11-175783 A 7/1999
JP 2001-307151 A 11/2001
JP 2003-16493 A 1/2003
JP 2003-150994 A 5/2003

* cited by examiner

*Primary Examiner*—Van T. Trieu
(74) *Attorney, Agent, or Firm*—Sughrue Mion, PLLC

(57) ABSTRACT

An on-vehicle terminal apparatus for a DSRC system includes a mobile station mounted on a car, a radio tag mounted on the car separately from the mobile station, and a first communication device provided for communication with the mobile station and a base station installed on a road. Information transmitted to the base from the mobile contains car information which serves to determine operation of application for which the DSRC system is employed. Tag information recorded in the tag contains the car information. The mobile station includes a second communication device for communication with the tag. The car information transmitted to the base station is acquired from the radio tag through the second communication means.

12 Claims, 6 Drawing Sheets

ON-VEHICLE TERMINAL APPARATUS FOR DEDICATED SHORT RANGE COMMUNICATION SYSTEM

BACKGROUND OF THE INVENTION

1. Field of the Invention

The present invention generally relates to an on-vehicle terminal apparatus for a dedicated short range communication system (hereinafter also referred to as the DSRC communication system only for the convenience of description) which apparatus is destined to be mounted on a motor vehicle having a radio tag installed therein. More particularly, the present invention is concerned with a technique for making it possible to utilize motor vehicle information without need for recording the vehicle information in the on-vehicle terminal apparatus itself to thereby render unnecessary the processing of recording the motor vehicle information which will otherwise have to be executed e.g. every time the on-vehicle terminal apparatus is lent out in the rental or the like business, whereby the handleability or serviceability of the on-vehicle terminal apparatus for the OSRC communication system is significantly enhanced.

2. Description of Related Art

In recent years, the system designed for carrying out toll collection transactions by making use of the DSRC communication (this system is generally known as the electronic toll collection automatic system or ETC system in abbreviation) has widely been adopted at the toll charge stations on the toll roads for the purpose of mitigating the traffic jam.

In the electronic toll collection automatic system (hereinafter also referred to as the ETC system), the toll charged for using the toll road is automatically collected at the toll station through radio-communication-based transaction between the ETC-dedicated on-road equipment which is installed at the site of the toll station (hereinafter this equipment will be referred to as the base station) and the on-vehicle terminal apparatus for the ETC system which is installed on the motor vehicle (hereinafter this apparatus will also be referred to as the mobile station or simply as the on-vehicle apparatus).

With the ETC system mentioned above, the time taken for the toll collect transaction is shorter than the time required for the toll collection by man power at the ordinary toll station. As a result of this, the number of the motor vehicles capable of passing through the gate within a predetermined time can be increased, which in turn contributes to mitigation of the traffic jam, as is known in the art.

In this conjunction, the toll charged for using the toll road generally differs in dependence on the types of the motor vehicles in many cases. Accordingly, in the ETC system, the amount of the toll as charged will have to be made different in dependence on the types of the motor vehicles.

Such being the circumstances, the vehicle type information is recorded in the on-vehicle apparatus for the ETC system so that the amounts of tolls which differ in dependence on the types of the motor vehicles can be charged on the basis of the vehicle type information. In that case, the records of the vehicle type information in the ETC-destined on-vehicle apparatuses are ordinarily placed under the management of a specific institution or organization with a view to preventing the illegal or unauthorized use of the records.

As exemplary or typical ones of the techniques concerning the on-vehicle terminal apparatuses for the DSRC communication systems known heretofore, there can be mentioned "a method of issuing on-vehicle apparatuses in an electronic toll collection automatic system" disclosed in Japanese Patent Application Laid-Open Publication No. 175783/1999 (J-P-A-1999-175783), "a gate apparatus, an on-vehicle apparatus, an on-vehicle apparatus set-up method, a toll collecting transaction method and an admission/leaving method" disclosed in Japanese Patent Application Laid-Open Publication No. 307151/2001 (J-P-A-2001-307151), "on-vehicle apparatus for a toll collecting transaction system" disclosed in Japanese Patent Application Laid-Open Publication No. 16493/2003 (J-P-A-2003-16493) and "ETC-destined on-vehicle apparatus" disclosed in Japanese Patent Application Laid-Open Publication No. 150994/2003 (J-P-A-2003-150994), by way of example.

In order to reduce or mitigate sufficiently the traffic jam with the aid of the toll collecting transaction system mentioned above, it is required that a number of motor vehicles traveling on the toll road, being aided with this system, exceeds a predetermined number. To this end, the number of the users of the ETC-destined on-vehicle apparatus must be correspondingly increased.

However, in order to utilize the system mentioned above, the user must purchase (or rent) the ETC-destined on-vehicle apparatus. In this conjunction, it is however noted that the user who uses the toll road less frequently does not dare to purchase the ETC-destined on-vehicle apparatus from the economical viewpoint in view of the fact that the effect is low for the cost involved in installing the ETC-destined on-vehicle apparatus on his or her car. For this reason, the use of the ETC-destined on-vehicle apparatus is not widely spread at present.

On the other hand, there has been proposed a method of lending out the ETC-destined on-vehicle apparatus only at the time of using the toll road to thereby promote the installation of the ETC-destined on-vehicle apparatus. In that case, however, very troublesome procedure is required because of the necessity of recording the motor vehicle information in the ETC-destined on-vehicle apparatus upon every lending out thereof. For this reason, the number of the users who resort to the ETC-destined on-vehicle apparatus rental method remains small.

The reason for such unpopularity as mentioned above may be explained by the fact that because the processing of recording the vehicle type information in the ETC-destined on-vehicle apparatus is executed under the management of a specific institute or organization for the purpose of preventing the illegal or unauthorized use, as pointed out previously, a lot of time is required for the user to complete the processing procedure of writing the motor vehicle information, which is effected every time the user hires the ETC-destined on-vehicle apparatus.

In the on-vehicle terminal apparatus for the DSRC communication system known heretofore, the processing of recording the vehicle type information in the ETC-destined on-vehicle apparatus is ordinarily executed under the management of the specific institution, as is described in every one of the Japanese Patent Application Laid-Open Publications enumerated previously. Consequently, difficulty has been encountered in spreading widely the use of the ETC-destined on-vehicle apparatus, which in turn means that the effect of mitigating the traffic jam has not yet been achieved regardless of introduction of the toll collecting transaction system based on the DSRC system, giving rise to a problem remaining to be solved.

SUMMARY OF THE INVENTION

In the light of the state of the art described above, it is an object of the present invention to provide an on-vehicle terminal apparatus for the DSRC communication system in which the motor vehicle information can be made use of without need for recording the motor vehicle information in the on-vehicle terminal apparatus itself regardless of the type of the motor vehicle so far as a radio tag has been installed in the motor vehicle and which is advantageously suited for application to the rental business of the on-vehicle terminal apparatus because of unnecessity of motor vehicle information recording processing upon every lending-out and thus can ensure much enhanced handleability or serviceability.

In view of the above and other objects which will become apparent as the description proceeds, there is provided according to a general aspect of the present invention an on-vehicle terminal apparatus for a DSRC system which apparatus includes a mobile station mounted on a motor vehicle, a radio tag mounted on the motor vehicle separately from the mobile station, and a first communication means provided in association with the mobile station for performing communication not only with the mobile station but also a base station installed in association with a road.

Information transmitted to the base station from the mobile station contains motor vehicle information which serves for determining operation of application for which the DSRC communication system is employed.

In the on-vehicle terminal of the DSRC communication system described above, tag information recorded in the radio tag contains the motor vehicle information.

The mobile station includes a second communication means for performing communication with the radio tag, and the motor vehicle information transmitted to the base station is acquired from the radio tag through the medium of the second communication means.

According to the teachings of the present invention, the motor vehicle information can be utilized without need for recording it in the on-vehicle terminal apparatus itself so far as the motor vehicle is installed with the radio tag, whereby the handleability or serviceability of the on-vehicle terminal apparatus can significantly be enhanced.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which:

FIG. 5 is a view for illustrating a so-called ETC rental business mode in which the ETC-destined on-vehicle apparatus for the DSRC communication system according to the first embodiment of the present invention is made use of.

DESCRIPTION OF THE PREFERRED EMBODIMENTS

Figure 1:
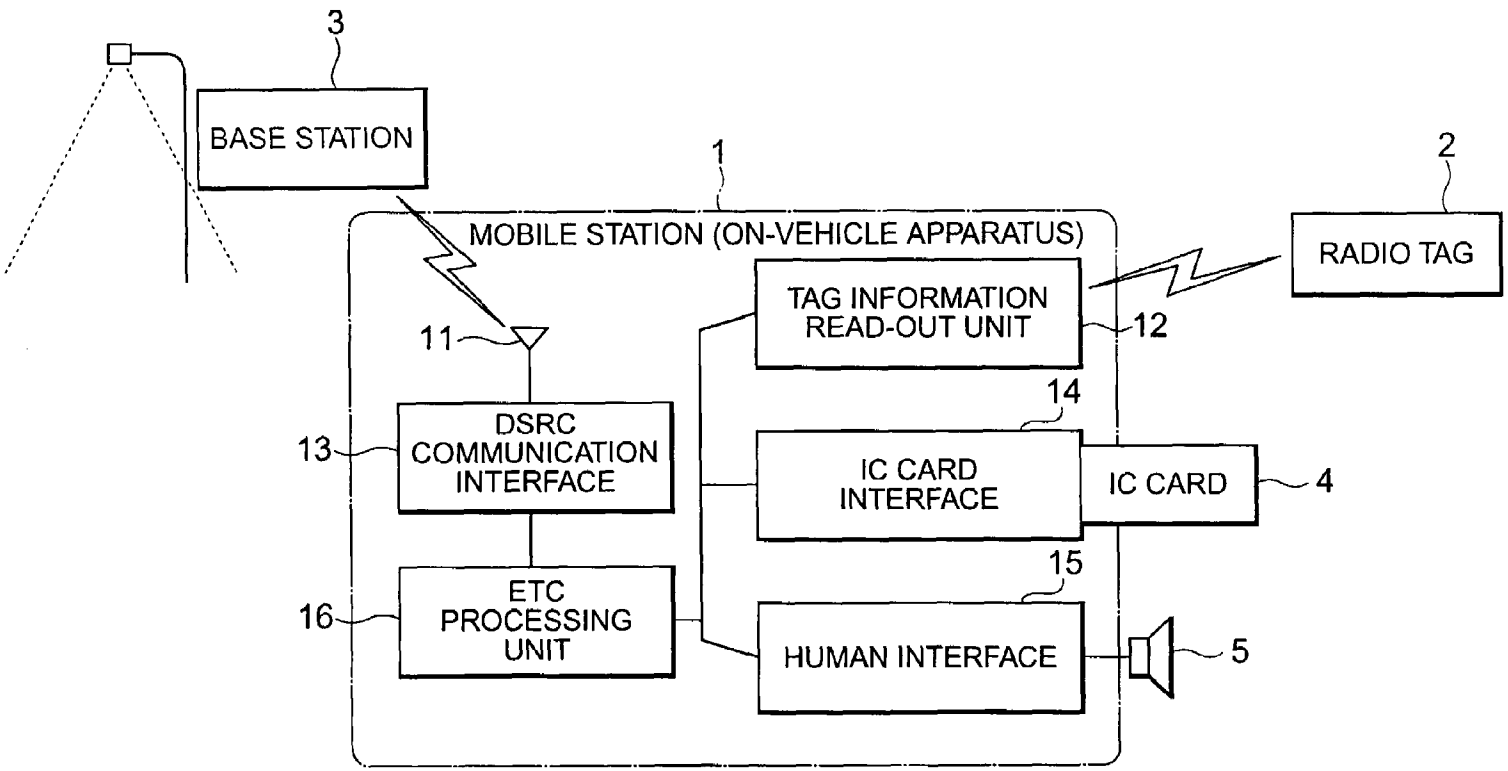
FIG. 1 is a block diagram showing an on-vehicle terminal apparatus for a DSRC communication system according to a first embodiment of the present invention.

The present invention will be described in detail in conjunction with what is presently considered as preferred or typical embodiments thereof by reference to the drawings. In the following description, like reference characters designate like or corresponding parts throughout the several views.

Embodiment 1

FIG. 1 is block diagram showing generally and schematically an arrangement of an on-vehicle terminal apparatus (i.e., terminal apparatus installed on a motor vehicle) for the DSRC communication system (Dedicated Short Range Communication system) according to a first embodiment of the present invention for illustrating a functional configuration internally of a mobile station 1 in association with an on-vehicle radio tag 2 (i.e., radio tag installed internally of a motor vehicle) and an on-road base station 3 (i.e., base station installed on a road) on the presumption that the teaching of the present invention is applied to, for example, an ETC (Electronic Toll Collection) automatic system (hereinafter referred to as the ETC system).

Referring to FIG. 1, the mobile station (on-vehicle apparatus) 1 which is mounted on a motor vehicle is so implemented as to be capable of communicating not only with the base station 3 installed on a road but also with the radio tag 2 which is mounted on the motor vehicle separately or independently from the mobile station (on-vehicle apparatus) 1.

An IC card 4 can removably be inserted into the mobile station 1. Further, the mobile station 1 is provided with a annunciator (or microphone) 5 for making possible voice information transfer between the driver and the mobile station 1.

The mobile station 1 and the radio tag 2 constitute the on-vehicle terminal apparatus, respectively, for the DSRC communication system.

The mobile station 1 is comprised of an antenna (first communication means) 11 for rendering it possible to perform radio communication with the base station 3, a tag information read-out unit (second communication means) 12 for reading out tag information from the radio tag 2 through communication therewith, a DSRC communication interface 13 for transmitting/receiving DSRC information through the medium of the antenna 11, and an IC card interface 14 into which the IC card 4 can removably be inserted, a human interface 15 connected to the annunciator (or microphone) 5, and an ETC processing unit 16 which is in charge of controlling all the functional units and components incorporated in the mobile station 1.

The ETC processing unit 16 includes or incorporates a temporary recording area (not shown) for storing the information read out from the radio tag 2 and an information writing or recording means (not shown either) for recording or storing the tag information as read out in the temporary recording area.

Figure 2:
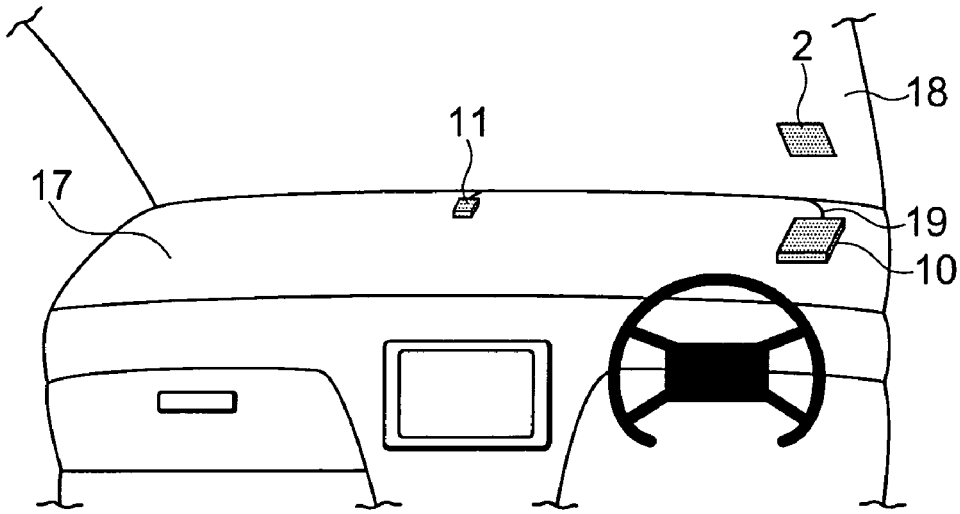
FIG. 2 is a view showing in outer appearance an array or disposition of major parts of the on-vehicle terminal apparatus according to the first embodiment of the present invention.

FIG. 2 is a view showing interior of the motor vehicle for illustrating disposition of the radio tag 2, the mobile station main body 10 and the antenna 11 constituting major parts of on-vehicle terminal apparatus for the DSRC communication system according to the first embodiment of the present invention.

Referring to FIG. 2, the mobile station main body 10 constituting a box-like casing of the mobile station 1 is disposed on a dash board (instrument board) 17 of the motor vehicle together with the antenna 11 while the radio tag 2 is installed on an inner surface of a windshield (front glass shield) 18 of the motor vehicle.

The tag information read-out unit 12, the DSRC communication interface 13, the IC card interface 14, the human interface 15 and the ETC processing unit 16 shown in FIG. 1 are mounted or packaged within the mobile station main body 10.

As can be seen in FIG. 2, the mobile station main body 10 and the radio tag 2 are disposed at respective positions close to each other for ensuring satisfactory communication between the tag information read-out unit 12 and the radio tag 2.

Further, the antenna 11 is connected to the DSRC communication interface 13 packaged within the mobile station main body 10 by means of a cable 19.

At this juncture, it should be added that although the above description has been made by reference to FIG. 2 that the mobile station main body 10 is mounted on the dash board (instrument board) 17 with the radio tag 2 being bonded to the inner surface of the windshield 18, the present invention is never restricted to any particular disposition. By way of example, the mobile station main body 10 and the radio tag 2 may be mounted equally within e.g. a so-called glove box as well so far as the mobile station main body 10 and the radio tag 2 can be disposed at the positions sufficiently close to each other.

The on-vehicle terminal apparatus of the DSRC communication system shown in FIGS. 1 and 2 are so implemented as to simplify the procedure demanded upon rental service of an ETC-destined on-vehicle apparatus by rendering unnecessary the processing for writing the motor vehicle information with a view to promoting wide-spread usage or popularization of the ETC-destined on-vehicle apparatus, which will be described in more detail later on.

More specifically, the motor vehicle information to be written is recorded in advance in the radio tag 2 of low cost which is installed interiorly of the motor vehicle, while the communication means (i.e., the tag information read-out unit 12) for communication with the radio tag 2 is provided in the ETC-destined on-vehicle apparatus (mobile station 1), wherein the tag information (motor vehicle information) is read out from the radio tag 2. In this way, the processing for writing the motor vehicle information in the ETC-destined on-vehicle apparatus itself is rendered unnecessary.

By way of example, information indicating the classification of the motor vehicle types on a concerned toll road for the motor vehicles each equipped with the ETC-destined on-vehicle apparatus can be recorded in the radio tag 2 as the tag information.

Figure 3A:
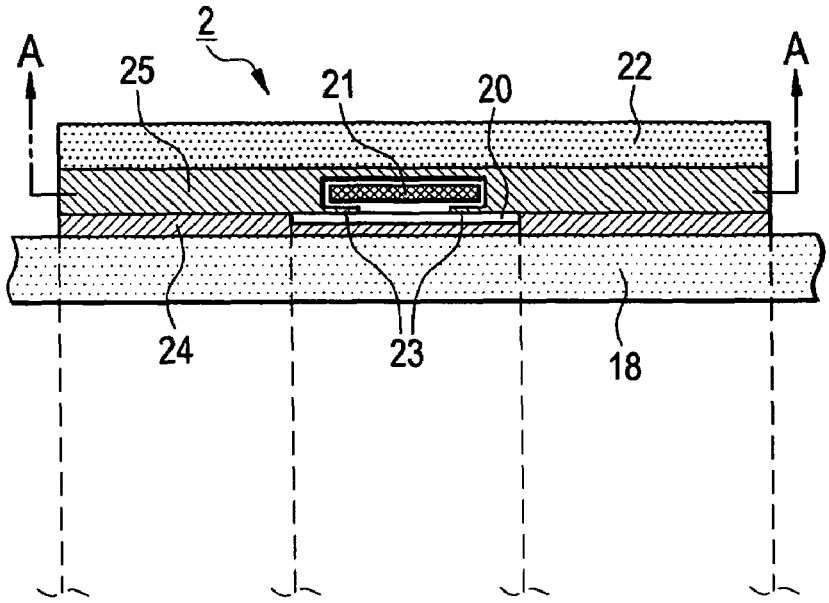
FIG. 3A is a side view showing in section a typical structure of a radio tag according to an embodiment of the present invention.
Figure 3B:
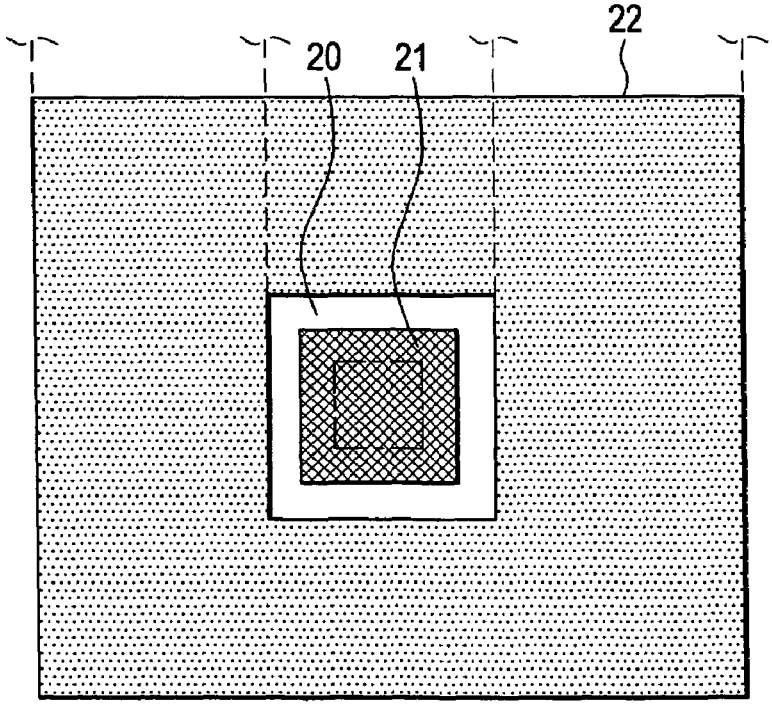
FIG. 3B is a sectional view taken along a line A—A in FIG. 3A, being viewed in the direction indicated by attached arrows.

FIG. 3A is a side view showing in section a typical structure of the radio tag 2, and FIG. 3B is a sectional view taken along a line A—A shown in FIG. 3A and viewed in the direction indicated by attached arrows.

Referring to FIGS. 3A and 3B, the radio tag 2 which is to be bonded to the windshield 18 is comprised of an IC chip 20 having a memory function and serving for the intrinsic function as the radio tag 2, a corrosive liquid pack 21 filled with a corrosive liquid solution for destroying the function of the IC chip 20 as it becomes necessary, a protection sheet 22 covering the surface of the radio tag 2, a destructive holder 23 which ordinarily serves for holding the corrosive liquid pack 21, and adhesive layers 24 and 25 for holding the IC chip 20 and the corrosive liquid pack 21 from the top and the bottom, respectively.

The adhesive layer 24 serves for securing the radio tag 2 onto the windshield 18 by bonding.

The destructive holder 23 is formed by an aperture edge portion of the adhesive layer 25 designed for housing the corrosive liquid pack 21 and destroying the corrosive liquid pack 21 upon removal of the radio tag 2 from the windshield 18 to thereby allow the corrosive liquid to flow out from the corrosive liquid pack 21 to the IC chip 20 for destruction thereof.

More specifically, when the protection sheet 22 is delaminated in an attempt for removing the radio tag 2, the destructive holder 23 destroys the corrosive liquid pack 21, as a result of which the corrosive liquid filled in the corrosive liquid pack 21 leaks out to thereby destroy the IC chip 20.

Thus, the corrosive liquid pack 21 and the destructive holder 23 cooperate to constitute a means for invalidating permanently the function of the radio tag 2 when the radio tag 2 is removed from the windshield 18.

Next, referring to a flow chart shown in FIG. 4, description will be made of operations carried out by the ETC processing unit 16 incorporated in the mobile station 1 according to the first embodiment of the present invention.

Figure 4:
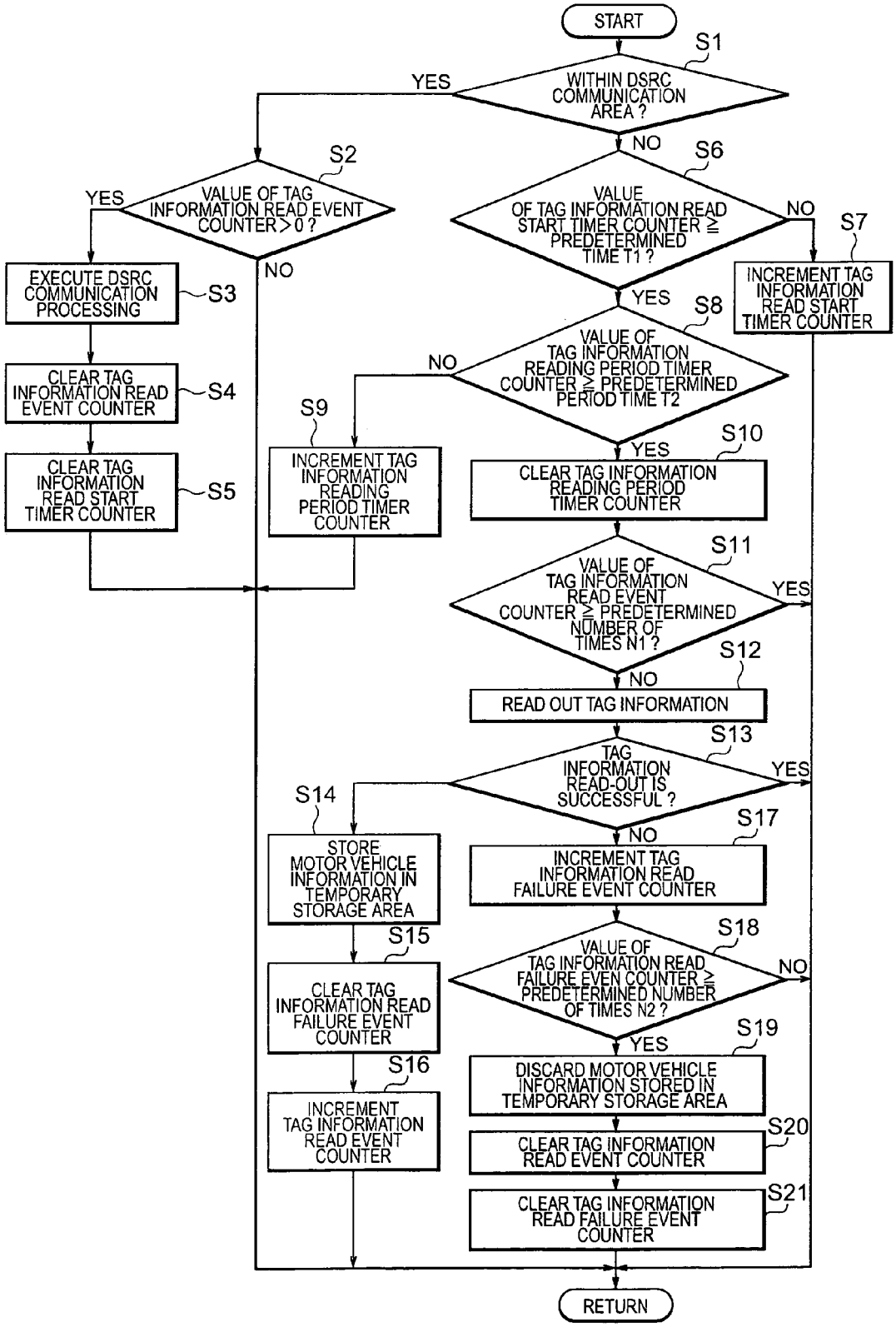
FIG. 4 is a flow chart for illustrating operations carried out by an ETC processing unit incorporated in the on-vehicle terminal apparatus according to the first embodiment of the present invention.

Firstly, it should be mentioned that the processing routine shown in FIG. 4 is repetitively executed periodically at a predetermined interval in succession to power-on of the mobile station 1 (mobile station main body 10).

At first, upon power-on of the mobile station 1, an initialize processing (not shown) is executed, whereby values of various counters employed in the course of execution of the processings shown in FIG. 4 are initialized.

By way of example, the initial values of a tag information read event counter and a tag information read failure event counter are, respectively, reset to "0", while those of a tag information read start timer counter and a tag information reading period timer counter are set to predetermined times T1 and T2, respectively, which serve as references in the decision processings, as will be elucidated later on.

In succession to the initialize processing, the ETC processing unit 16 makes decision as to whether or not the mobile station 1 (motor vehicle) has entered a DSRC communication area on the basis of the state of the DSRC communication interface 13 (step S1).

When it is determined that the motor vehicle has entered the DSRC communication area (i.e., when the decision step S1 results in affirmation "Yes"), then decision is made in succession as to whether or not the count value of the tag information read event counter is other than "0" (i.e., greater than "0") in a step S2.

In the case where the read processing of the vehicle classification information has not been completed yet with the result that the value or count of the tag information read event counter is determined as "0" (i.e., when the decision step S2 results in negation "No"), the processings in succeeding steps S3 et seq. are not executed but the processing routine shown in FIG. 4 is immediately terminated.

On the other hand, when the processing of reading out the vehicle classification information from the radio tag 2 has been completed with the result that it is determined in the step S2 that the value of the tag information read event counter is greater than "0" (i.e., when the step S2 results in "Yes"), the DSRC communication processing (step S3) is executed, whereby the tag information read event counter is cleared in a step S4 with the tag information read start timer counter being cleared as well in a step S5, whereupon the processing routine shown in FIG. 4 is left.

At that time point, the ETC processing unit 16 executes the DSRC communication processing (step S3) to thereby send out to the base station 3 (on-road equipment) the identification information contained in the IC card 4 inserted in the IC card interface 14 (IC card read-out unit) and the vehicle classification information recorded in the temporary recording area as the own vehicle information (i.e., the information of the motor vehicle now concerned).

Further, after completion of the DSRC communication processing (step S3), the processing of clearing the tag information read event counter (step S4) is executed for reading out again the tag information recorded in the radio tag 2 to thereby update the vehicle type information stored or recorded in the temporary recording area.

Additionally, after lapse of the predetermined time T1 since the completion of the DSRC communication processing (step S3), the processing of clearing the tag information read start timer counter (step S5) is executed to start the processing of updating the vehicle type information (step S4).

On the other hand, when it is determined in the step S1 that the motor vehicle has not entered the DSRC communication area (i.e., when the step S1 results in "No"), then decision is made in succession as to whether or not the predetermined time T1 has lapsed after the completion of the DSRC communication processing (step S3) by checking whether or not the value of the tag information read start timer counter has reached or exceeded the predetermined time T1 (step S6).

In the case where the predetermined time T1 has not lapsed yet with the result that it is determined in the step S6 that the value of the tag information read start timer counter is less than the predetermined time T1 (i.e., when "No" in the step S6), the count value of the tag information read start timer counter is incremented by "1" in a step S7, whereupon the processing routine shown in FIG. 4 is left.

By contrast, when it is determined in the step S6 that the count value of the tag information read start timer counter ≧T1 (i.e., when "Yes" in the step S6), then decision is made whether or not the predetermined time T2 has lapsed since the execution of the preceding tag information read processing by checking whether or not the count value of the tag information reading period timer counter is equal to or exceeds the predetermined time T2 (step S8).

On the contrary, in the case where the predetermined time has not lapsed yet with the result that it is determined in the step S8 that the value of the tag information reading period timer counter <T2 (i.e., when "No" in the step S8), the value of the tag information reading period timer counter is incremented by "1" in a step S9, whereon the processing routine shown in FIG. 4 is left.

On the other hand, when the time longer than the predetermined time inclusive has lapsed since the preceding tag information read processing and hence it is determined in the step S8 that the count value of the tag information reading period timer counter ≧T2 (i.e., "Yes" in the step S8), the value of the tag information reading period timer counter is cleared in a step S10, which is then followed by a step S11 where decision is made as to whether or not the information reading of the radio tag 2 has been carried out a predetermined number of times N1 inclusive by checking whether or not the count value of the tag information read event counter is greater than the predetermined number of times N1 inclusive.

In the case where the tag information read processing has been executed by the predetermined number of times N1 and hence it is determined in the step S11 that the count value of the tag information read event counter ≧N1 (i.e., when "Yes" in the step S11), then the processing routine shown in FIG. 4 is immediately left without executing any other succeeding steps S12 et seq.

On the contrary, when it is determined in the step S11 that the count value of the tag information read event counter <N1 (i.e., when "No" in the step S11), the processing of reading out the tag information from the radio tag 2 is executed (step S12), whereon decision is made in a step S13 as to whether or not the tag information read processing (step S12) has actually been successful.

Through the decision step S11 mentioned above, the tag information read processing (step S12) is executed by the predetermined number of times N1.

Incidentally, at the time point of power-on, the predetermined time T2 is set at the tag information reading period timer counter with the tag information read event counter being cleared to "0". Thus, at this time point, the tag information read processing (step S12) is executed.

Further, through the decision step S6 mentioned above, processing of updating the vehicle type information recorded in the temporary recording area is not executed until the processing of incrementing the value of the tag information read start timer counter (step S7) has been repetitively executed for a predetermined number of times (equivalent to the predetermined time T1) after the processing of clearing the count value of the tag information read start timer counter (step S5) had been executed.

Besides, through the decision step S8 mentioned above, the tag information read processing (step S12) is executed at every predetermined period (equivalent to the predetermined time T2).

When it is determined in the step S13 that the tag information read processing in the step S12 has been successful (i.e., when "Yes" in the step S13), then the vehicle classification information is recorded in the temporary recording area incorporated in the mobile station 1 (on-vehicle apparatus) in a step S14 with the tag information read failure event counter being cleared in a step S15, which is then followed by a step S16 in which the tag information read event counter is incremented by "1", whereupon the processing routine shown in FIG. 4 is left.

By contrast, when it is determined in the step S13 that the tag information read processing in the step S12 has failed (i.e., when "No" in the step S13), the tag information read failure event counter is incremented by "1" in a step S17, whereon decision is made whether or not the value of the tag information read failure event counter is greater than the predetermined number of times N2 inclusive (step S18).

When it is determined in the step S18 that the value of the tag information read failure event counter ≧N2 (i.e., when "No" in the step S18), then the processing routine shown in FIG. 4 is immediately left without executing any succeeding steps S19 et seq.

On the other hand, when it is determined in the step S18 that the count value of the tag information read failure event counter ≧ predetermined number of times N2 (i.e., when "Yes" in the step S18), the motor vehicle information stored in the temporary recording area is discarded (step S19), whereon the tag information read event counter is cleared (step S20) and then the tag information read failure event counter is cleared (step S21). Then, the processing routine is left.

Figure 5:
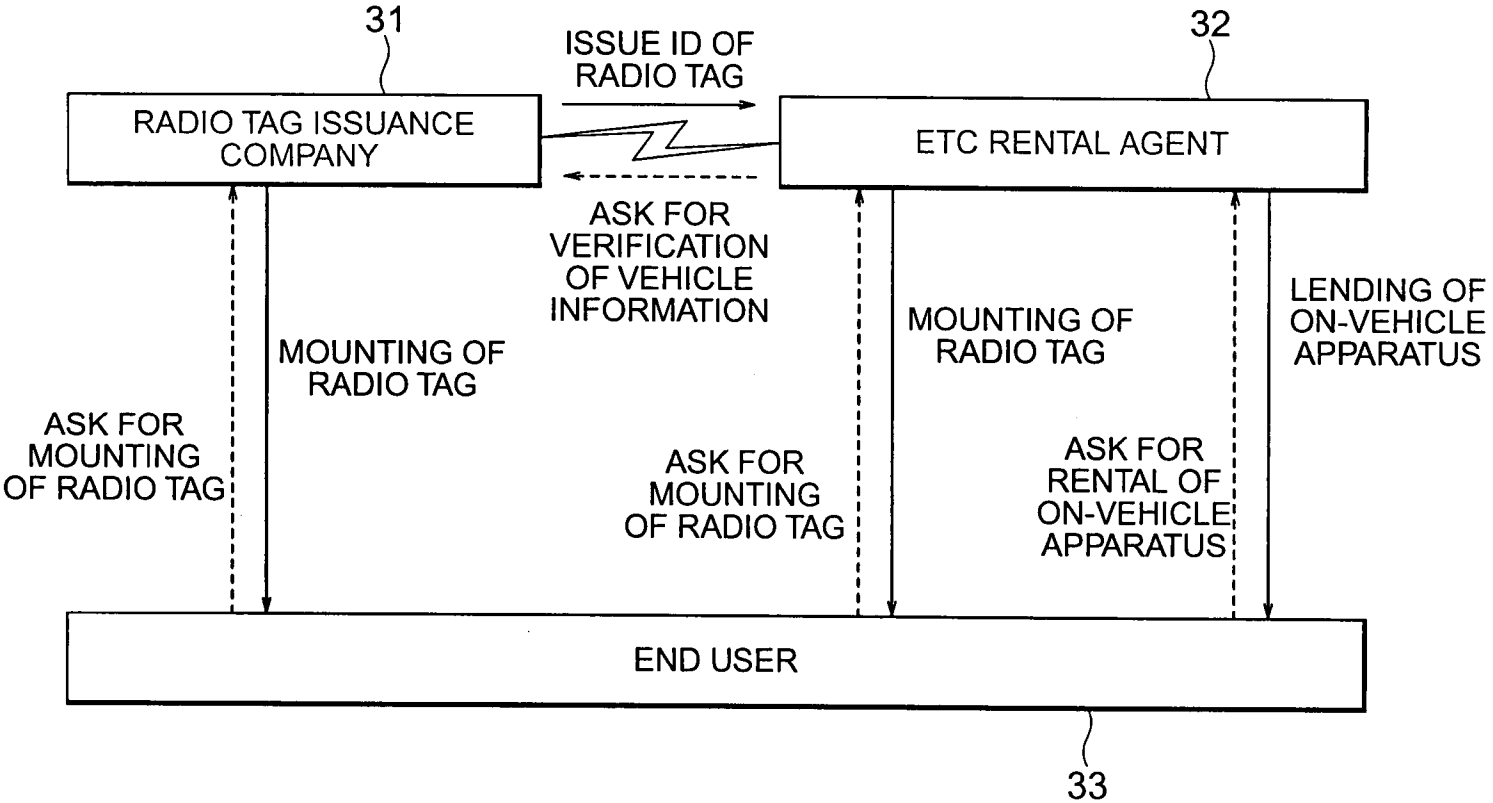
Figure 6:
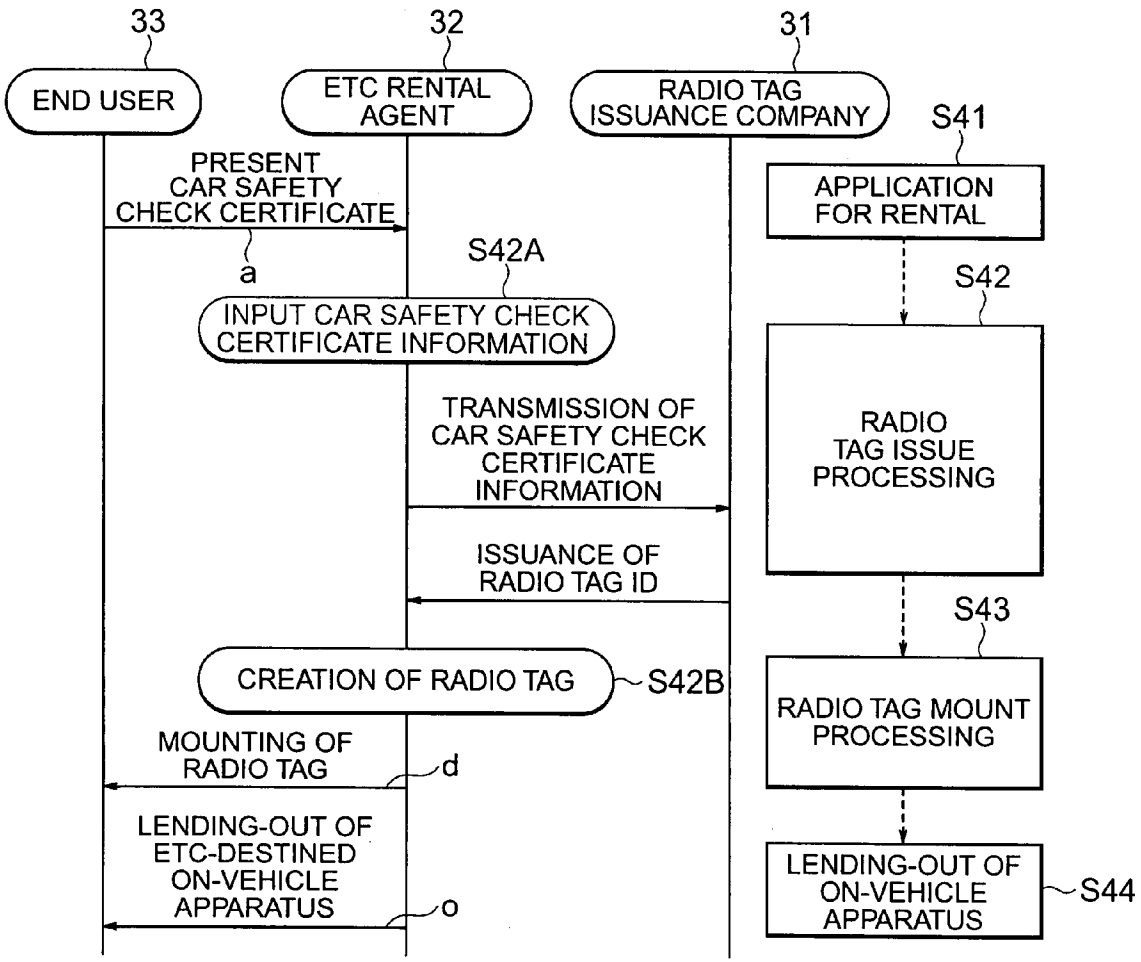
FIG. 6 is a flow chart illustrating schematically a processing procedure for the rental of the ETC-destined on-vehicle apparatus according to the first embodiment of the present invention.

Next, referring to FIGS. 5 and 6, description will turn to an exemplary practical application mode of the on-vehicle terminal apparatus for the DSRC communication system according to the first embodiment of the present invention.

FIG. 5 is a view for illustrating a so-called ETC rental business mode in which the on-vehicle terminal apparatus for the DSRC communication system according to the first embodiment of the invention is made use of. In the figure, interrelations between a particular institution or organization which handles the mobile stations 1 and the radio tags 2 and the users are shown together with various processing procedures and the statuses of information transactions.

Referring to FIG. 5, a mutual communication channel is established between a radio tag issuance company 31 which is in charge of issuing the radio tags 2 and a ETC rental agent 32 whose business is to lend out the ETC-destined on-vehicle apparatus (mobile station 1).

Thus, the radio tag issuance company 31 is capable of issuing identification information (hereinafter referred to as the ID) of the radio tag 2 to the ETC rental agent 32 through the medium of a communication means (see solid line arrow in FIG. 5), whereas the ETC rental agent 32 can ask the radio tag issuance company 31 for certification of the motor vehicle information through the communication means (see broken line arrow in FIG. 5).

Further, the radio tag issuance company 31 and the ETC rental agent 32 can provide services such as "mounting of the radio tag 2" and "rental of the on-vehicle apparatus" to the end user 33 (see solid line arrows) in conformance with the request from the end user 33 (see broken line arrow).

The ETC rental agent 32 examined by the radio tag issuance company 31 performs the lend-out or rental work of the on-vehicle apparatus to the end user 33 as well as the work for mounting the radio tag 2 on the motor vehicle of the end user 33.

In the ID of the radio tag 2 issued by the radio tag issuance company 31 to the ETC rental agent 32, there is contained the vehicle classification information mentioned previously in an encrypted form.

The radio tag issuance company 31 examines whether or not the ETC rental agent 32 is capable of mounting the radio tag 2 having the ID written therein on the motor vehicle corresponding to the ID without illegality or iniquity.

Thus, the radio tag issuance company 31 can ensure that the vehicle classification information of the motor vehicle on which the radio tag 2 (having the issued ID written therein) is mounted is correct or legal.

Incidentally, the service of issuing the radio tag 2 can be provided directly by the radio tag issuance company 31, as the case may be.

FIG. 6 is a flow chart illustrating schematically a processing procedure for the rental of the ETC-destined on-vehicle apparatus.

More specifically, shown in FIG. 6 is a rental procedure (steps S41 to S44) in the case where the radio tag 2 is not yet mounted on the motor vehicle used by an end user 33 together with interrelations among the radio tag issuance company 31, the ETC rental agent 32 and the end user 33 in parallel.

In the case where the radio tag 2 is not mounted on the motor vehicle used by the end user 33 yet, the rental procedure is executed in conformance with the procedure illustrated in FIG. 6.

Referring to FIG. 6, the end user 33 presents at first the car safety check certificate to the ETC rental agent 32 (see an arrow a) and applies for the rental of the ETC-destined on-vehicle apparatus (step S41).

In response, the ETC rental agent 32 performs firstly the input processing of the car safety check certificate information in a step S42A in precedence to the processing for issuing the radio tag 2 in a step S42.

More specifically, the ETC rental agent 32 inputs the car safety check certificate information to a terminal connected to the radio tag issuance company 31 on an on-line basis to thereby transmit the car safety check certificate information to the radio tag issuance company 31 (see arrow b).

In succession, upon reception of the car safety check certificate information, the radio tag issuance company 31 issues a unique ID of the radio tag 2 in conformance with the vehicle classification information on the basis of the car safety check certificate information and encrypts the ID. The ID issued in this way is then sent back to the ETC rental agent 32 (see an arrow c).

Upon reception of the ID from the radio tag issuance company 31, the ETC rental agent 32 writes the received ID in the radio tag 2 to thereby create the radio tag 2 in which the ID is written (step S42B). Thus, the processing of issuing the radio tag 2 (step S42) has been completed.

Finally, the ETC rental agent 32 performs the processing of mounting the radio tag 2 on the motor vehicle of the end user 33 in a step S43 (see an arrow d) and lends out the ETC-destined on-vehicle apparatus to the end user 33 (see an arrow e). Now, the rental processing comes to an end (step S44).

Subsequently, the end user 33 can make use of the ETC-destined on-vehicle apparatus with ease while avoiding the unauthorized use.

Thereafter, so far as the radio tag 2 has been mounted once on the motor vehicle in which the ETC-destined on-vehicle apparatus is to be used, the end user 33 can complete the rental procedure simply by renting or hiring the ETC-destined on-vehicle apparatus from the ETC rental agent 32. Thus, when the ETC-destined on-vehicle apparatus has once been rented, there is no more required to execute again the procedure shown in FIG. 6.

As is apparent from the foregoing description, the on-vehicle terminal apparatus (e.g. the ETC-destined on-vehicle apparatus) for the DSRC communication system according to the first embodiment of the present invention (see FIG. 1) is so arranged that the radio tag 2 having the motor vehicle information recorded therein is mounted on the motor vehicle, while the on-vehicle mobile station 1 is provided with the antenna 11 (first communication means) for conducting communication with the on-road base station 3 and the tag information read-out unit 12 (second communication means) for performing communication with the radio tag 2 so that the motor vehicle information to be sent to the base station 3 from the mobile station 1 can be acquired from the radio tag 2 through the medium of the tag information read-out unit 12.

Thus, so far as the motor vehicle having the radio tag 2 installed therein is concerned, the user of any motor vehicle can utilize the motor vehicle information without need for recording the motor vehicle information in the mobile station 1 (on-vehicle apparatus). Consequently, especially in the on-vehicle apparatus rental business, there arises no necessity of recording the motor vehicle information upon every rental of the on-vehicle apparatus. This means that remarkably enhanced convenience can be ensured for the rental of the on-vehicle apparatus such as the ETC-destined on-vehicle apparatus.

Further, as described hereinbefore in conjunction with FIG. 3, the radio tag 2 includes a function disabling means (the corrosive liquid pack 21 and the destructive holder 23) for invalidating permanently the IC function of the radio tag 2 when the radio tag 2 is detached from the motor vehicle. Thus, even in the case where the radio tag 2 should be stolen, such situation can never occur that the stolen radio tag 2 is mounted on another motor vehicle for illegal use.

Further, since the motor vehicle information recorded in the radio tag 2 contains the vehicle type information concerning the classification of the motor vehicle types on the per toll road basis, the vehicle classification at the toll station of the toll road can automatically be carried out with ease, whereby the serviceability as the on-vehicle terminal apparatus can remarkably be enhanced.

In general, in the ETC or the like application, communication is performed while the motor vehicle is traveling within the communication area of the base station 3. Accordingly, it is desirable that the time taken for the transmission/reception processing of the information transferred between the mobile station 1 and the base station 3 is short.

According to the teachings of the present invention incarnated in the first embodiment thereof, the mobile station 1 is equipped with the information recording means for storing or recording in the temporary recording area of the ETC processing unit 16 the tag information read out through the tag information read-out unit 12, wherein the information recorded in the temporary recording area is transmitted to the base station 3.

In that case, since the tag information has been recorded in the temporary recording area incorporated in the mobile station 1 through communication with the radio tag 2 before the motor vehicle enters the communication area, the time taken for the mobile station 1 to read out the information from the temporary recording area when the motor vehicle enters the communication area of the base station 3 is extremely short as compared with the time required for reading out the information upon communication with the radio tag 2. Thus, with the teachings of the present invention incarnated in the first embodiment thereof, the information transmission/reception processing carried out between the mobile station 1 and the base station 3 can be completed within a short time.

Further, since the mobile station 1 is so arranged as to read out the tag information recorded in the radio tag 2 upon every power-on of the mobile station to thereby record the tag information in the temporary recording area, it is possible to write the information recorded in the radio tag 2 into the temporary recording area incorporated in the mobile station 1 with ease and without fail.

Besides, because the mobile station 1 is so arranged as to read out the tag information recorded in the radio tag 2 upon every completion of the DSRC communication for thereby recording the tag information in the temporary recording area in order to update the information recorded in the temporary recording area, such unauthorized use can positively be prevented that the on-vehicle apparatus of other vehicle is intactly installed in the own vehicle after the read processing of the motor vehicle information of the other vehicle to behave as if the other vehicle were the own vehicle.

In other words, since the read processing is again executed after the DSRC communication, it is possible to prevent twice or more unauthorized uses in succession.

Additionally, by virtue of such arrangement of the mobile station 1 that the tag information recorded in the radio tag 2 is read out to be recorded in the temporary recording area after lapse of the predetermined time T1 since the end processing of the DSRC communication in order to update the information recorded in the temporary recording area, there will never arise such situation that in the case where two or more communication areas are laid in juxtaposition, the DSRC communication processing and the information read processing from the radio tag 2 are executed simultaneously in the succeeding one of the juxtaposed communication areas, and thus it can be avoided that the information transmission/reception is thereby extended.

Besides, by virtue of such arrangement of the mobile station 1 that after the successful read processing of the tag information recorded in the radio tag 2, the information recorded in the radio tag is read out by the first predetermined number of times N1 at the predetermined period (predetermined time T2) to be recorded in the temporary recording area, the possibility of both the DSRC communication processing and the tag information read processing may simultaneously be executed can be reduced.

Thus, extension of the information transmission/reception time due to the simultaneous execution of the DSRC communication processing and the tag information read processing can be evaded.

Further, such unauthorized use that the on-vehicle apparatus of other motor vehicle is intactly installed in the own motor vehicle after the read processing of the motor vehicle information of the other motor vehicle to behave as if the own motor vehicle were the other motor vehicle can positively be excluded. To say in another way, attempt for the unauthorized use of the on-vehicle apparatus such as mentioned above is difficult to realize because then the mobile station 1 must be located in the vicinity of the other motor vehicle over a predetermined time.

Moreover, owing to such arrangement of the mobile station 1 that the tag information recorded in the radio tag 2 is read out at a predetermined period to be recorded in the temporary recording area and when the read processing of the tag information from the radio tag 2 has failed at least the second predetermined number of times N2, the information recorded in the temporary recording area is discarded, such unauthorized use that after the read processing of the motor vehicle information of other motor vehicle, the on-vehicle apparatus of the other vehicle is installed as it is in the own motor vehicle to behave like the other vehicle can be excluded.

Many features and advantages of the present invention are apparent from the detailed description and thus it is intended by the appended claims to cover all such features and advantages of the apparatus which fall within the spirit and scope of the invention. Further, since numerous modifications and changes will readily occur to those skilled in the art, it is not desired to limit the invention to the exact construction and operation illustrated and described. Accordingly, all suitable modifications and equivalents may be resorted to, falling within the scope of the invention.

What is claimed is:

1. An on-vehicle terminal apparatus for a dedicated short range communication system, comprising:

a mobile station mounted on a motor vehicle;

a radio tag mounted on said motor vehicle separately from said mobile station; and first communication means provided in association with said mobile station for performing communication not only with said mobile station but also with a base station installed in association with a road, wherein information transmitted to said base station from said mobile station contains motor vehicle information which serves for determining operation of application for which said dedicated short range communication system is employed, wherein tag information recorded in said radio tag contains said motor vehicle information, wherein said mobile station includes second communication means for performing communication with said radio tag, and wherein said motor vehicle information transmitted to said base station is acquired from said radio tag through the medium of said second communication means.

2. An on-vehicle terminal apparatus for a dedicated short range communication system according to claim 1, wherein said radio tag includes function destroying means for permanently disabling an entire functionality of said radio tag.

3. An on-vehicle terminal apparatus for a dedicated short range communication system according to claim 1, wherein said motor vehicle information recorded in said radio tag contains vehicle type information concerning classification of the motor vehicle types on a per toll road basis.

4. An on-vehicle terminal apparatus for a dedicated short range communication system according to claim 1, said mobile station including:

a temporary recording area;

information reading means for reading out said tag information recorded in said radio tag; and information recording means for recording the tag information read out by said information reading means in said temporary recording area, wherein said first communication means is designed to transmit the information recorded in said temporary recording area to said base station.

5. An on-vehicle terminal apparatus for a dedicated short range communication system according to claim 4, wherein said mobile station is so arranged that upon power-on of said mobile station, said tag information is read out from said radio tag to be recorded in said temporary recording area.

6. An on-vehicle terminal apparatus for a dedicated short range communication system according to claim 4, wherein said mobile station is so arranged that after completion of the dedicated short range communication, said tag information is read out from said radio tag to be recorded in said temporary recording area for updating the information recorded in said temporary recording area.

7. An on-vehicle terminal apparatus for a dedicated short range communication system according to claim 6, wherein said mobile station is so arranged that after lapse of a predetermined time since completion of end processing of the dedicated short range communication, said tag information is read out from said radio tag to be recorded in said temporary recording area for updating the information recorded in said temporary recording area.

8. An on-vehicle terminal apparatus for a dedicated short range communication system according to claim 4, wherein said mobile station is so arranged that after the processing for reading out said tag information has ended successfully, said tag information is read out from said radio tag by a first predetermined number of times at a predetermined period to be recorded in said temporary recording area.

9. An on-vehicle terminal apparatus for a dedicated short range communication system according to claim 4, wherein said mobile station is arranged such that the tag information is read out from said radio tag at a predetermined period to be recorded in said temporary recording area and that when processing for reading out said tag information has failed at least a second predetermined number of times, the information recorded in said temporary recording area is discarded.

10. The on-vehicle terminal apparatus for a dedicated short range communication system according to claim 1, wherein said radio tag is installed on a surface of a windshield.

11. The on-vehicle terminal apparatus for a dedicated short range communication system according to claim 1, wherein said mobile station is disposed on a dashboard.

12. The on-vehicle terminal apparatus for a dedicated short range communication system according to claim 1, wherein at least one of said radio tag and said mobile station is disposed in a compartment.

* * * * *